US011785390B2

(12) United States Patent
Yokota et al.

(10) Patent No.: US 11,785,390 B2
(45) Date of Patent: Oct. 10, 2023

(54) ACOUSTIC TRANSDUCER

(71) Applicants: Wataru Yokota, Kanagawa (JP); Goichi Akanuma, Kanagawa (JP)

(72) Inventors: Wataru Yokota, Kanagawa (JP); Goichi Akanuma, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/672,691

(22) Filed: Feb. 16, 2022

(65) Prior Publication Data

US 2022/0264225 A1 Aug. 18, 2022

(30) Foreign Application Priority Data

Feb. 17, 2021 (JP) ..... 2021-023186

(51) Int. Cl.
*H04R 7/02* (2006.01)

(52) U.S. Cl.
CPC ..... *H04R 7/02* (2013.01)

(58) Field of Classification Search
CPC ..... H04R 7/02
USPC ..... 381/423
See application file for complete search history.

(56) References Cited

U.S. PATENT DOCUMENTS

2007/0286438 A1* 12/2007 Hirade ..... H04R 19/04 381/174
2009/0190782 A1* 7/2009 Suzuki ..... H04R 31/00 381/174
2009/0262098 A1 10/2009 Yamada
2015/0382091 A1* 12/2015 Kim ..... H04R 19/04 381/174
2016/0088402 A1* 3/2016 Hu ..... H04R 19/005 381/174
2018/0130458 A1 5/2018 Chu
2020/0178000 A1 6/2020 Niekiel et al.

FOREIGN PATENT DOCUMENTS

| | | | |
|---|---|---|---|
| EP | 2 597 894 | A1 | 5/2013 |
| EP | 3 937 509 | A1 | 1/2022 |
| JP | 2001-016692 | A | 1/2001 |
| JP | 2005-244804 | | 9/2005 |
| JP | 2009-258569 | | 11/2009 |
| JP | 2012-134591 | | 7/2012 |
| JP | 2014-160915 | | 9/2014 |
| JP | 2015-159537 | | 9/2015 |
| JP | 2020-527308 | | 9/2020 |
| WO | WO2007/060768 | A1 | 5/2007 |

OTHER PUBLICATIONS

Extended European Search Report dated Jul. 14, 2022 in European Patent Application No. 22155613.7, 10 pages.

* cited by examiner

*Primary Examiner* — Sean H Nguyen
(74) *Attorney, Agent, or Firm* — XSENSUS LLP

(57) ABSTRACT

An acoustic transducer includes a diaphragm and multiple vibrators to drive the diaphragm. The diaphragm has multiple cutouts and includes multiple arrangement portions. The multiple vibrators are disposed on the multiple arrangement portions, respectively. At least one of the multiple arrangement portions is disposed between two of the multiple cutouts adjacent to each other and supported at both ends thereof.

11 Claims, 17 Drawing Sheets

COMPARATIVE EXAMPLE

COMPARATIVE EXAMPLE

FIG. 6A COMPARATIVE EXAMPLE
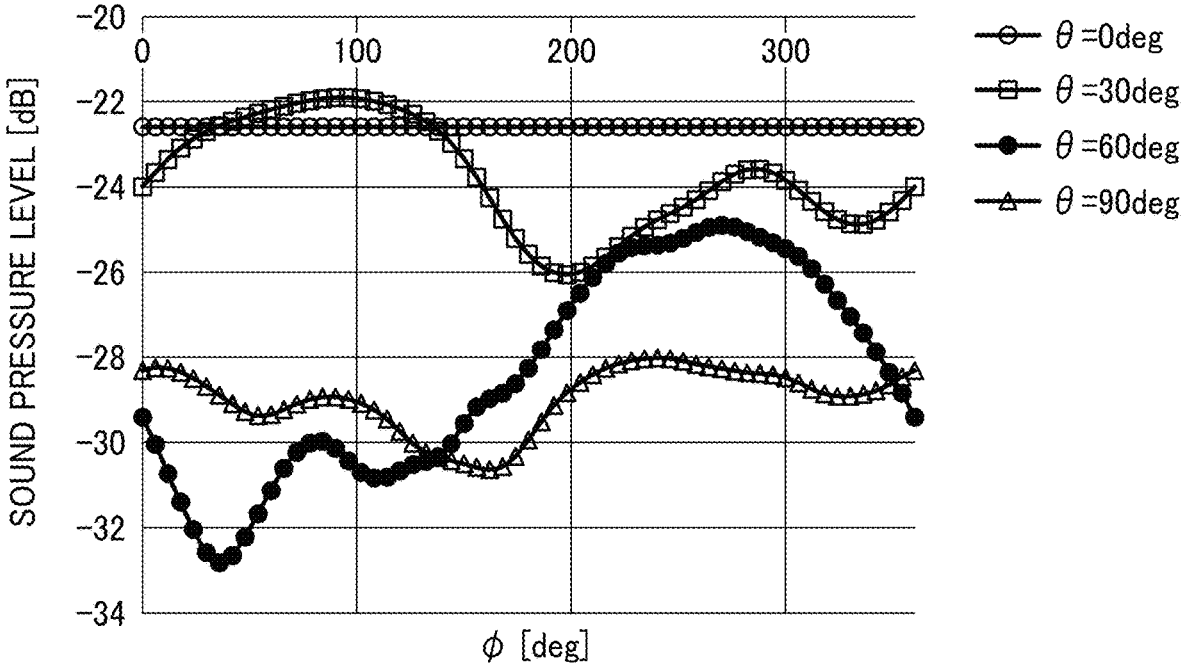
FIG. 6B
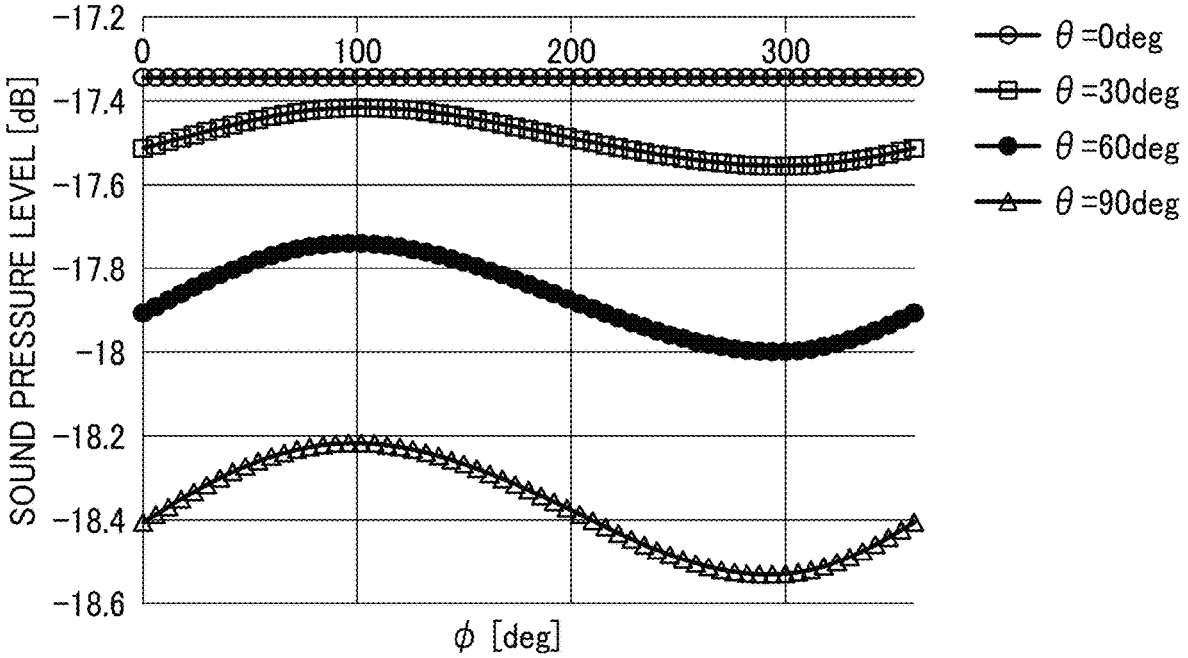

ACOUSTIC TRANSDUCER

CROSS-REFERENCE TO RELATED APPLICATION

This patent application is based on and claims priority pursuant to 35 U.S.C. § 119(a) to Japanese Patent Application No. 2021-023186, filed on Feb. 17, 2021, in the Japan Patent Office, the entire disclosure of which is hereby incorporated by reference herein.

BACKGROUND

Technical Field

Aspects of the present disclosure relate to an acoustic transducer.

Description of the Related Art

There is known an acoustic transducer including an actuator divided by a gap.

SUMMARY

Embodiments of the present disclosure describe an improved acoustic transducer that includes a diaphragm and multiple vibrators to drive the diaphragm. The diaphragm has multiple cutouts and includes multiple arrangement portions. The multiple vibrators are disposed on the multiple arrangement portions, respectively. At least one of the multiple arrangement portions is supported at both ends thereof.

The at least one of the multiple arrangement portions is disposed between two of the multiple cutouts adjacent to each other, or two of the multiple cutouts adjacent to each other are disposed on both sides with respect to a line connecting the both ends at which the at least one of the multiple arrangement portions is supported

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein:

FIGS. 6A and 6B are graphs illustrating directivity of sound pressure according to the second comparative example and the present embodiment;

Figure 1B:
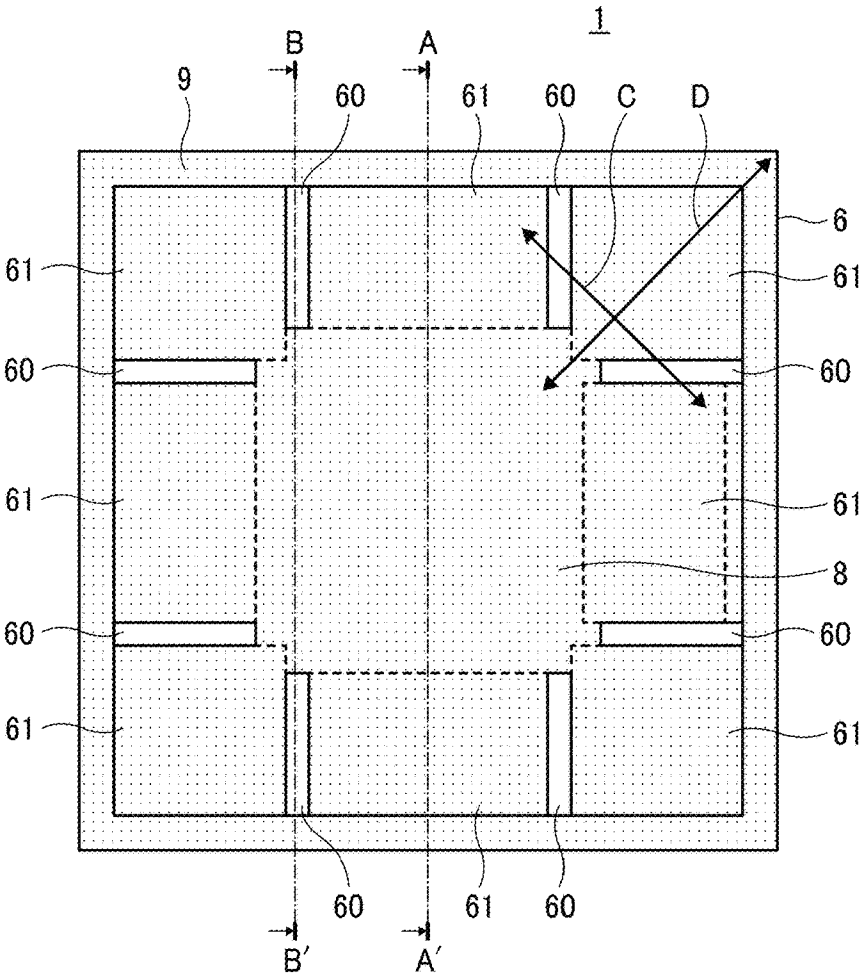
FIGS. 1A and 1B are schematic views of an acoustic transducer according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a," "an," and "the" are intended to include the plural forms as well, unless the context clearly indicates otherwise.

Figure 1A:
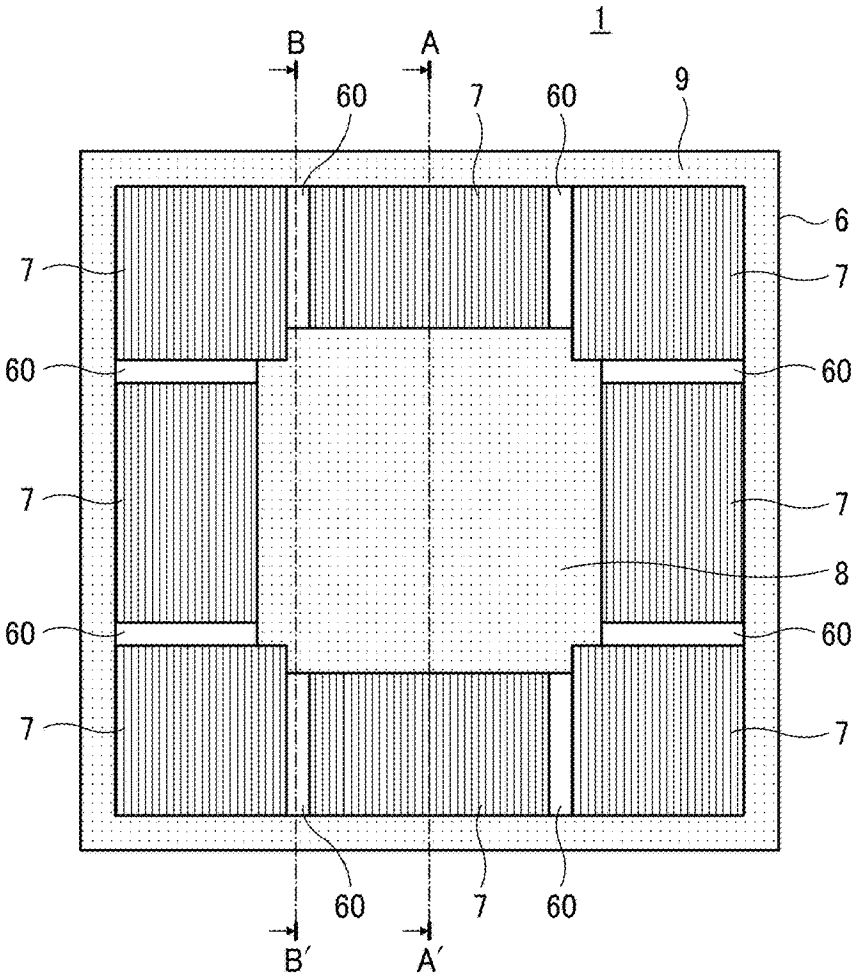

FIGS. 1A and 1B are schematic views of an acoustic transducer 1 according to an embodiment of the present disclosure. The acoustic transducer 1 includes a diaphragm 6 and multiple piezoelectric drivers 7. The diaphragm 6 has a square shape and multiple cutouts 60. The multiple piezoelectric drivers 7 are disposed on the diaphragm 6 to drive the diaphragm 6. The piezoelectric driver 7 is an example of a vibrator.

The diaphragm 6 is formed of silicon. The diaphragm 6 includes a center portion 8 and multiple arrangement portions 61 disposed in a portion excluding the center portion 8. The multiple piezoelectric drivers 7 are disposed in the multiple arrangement portions 61, respectively. Each of the multiple cutouts 60 is a slit disposed in the portion of the diaphragm 6 excluding the center portion 8. Each cutout 60 is not limited to the slit formed continuously in a straight line, and may be, for example, multiple dots arranged intermittently in a straight line.

As a voltage is applied to the piezoelectric driver 7 along the out-of-plane direction, the piezoelectric film included in the piezoelectric driver 7 contracts in the in-plane direction, and the piezoelectric driver 7 with the diaphragm 6 as unimorph deforms in the out-of-plane direction. As the voltage applied to the piezoelectric driver 7 changes with time, the surface of the diaphragm 6 vibrates to generate a pressure wave in ambient air, which is sensed by a person as a sound. An input voltage waveform is electrically converted from a waveform of sound to be reproduced. This voltage waveform is input to the piezoelectric driver 7 to reproduce the sound.

The same voltage waveform is applied to the multiple piezoelectric drivers 7 on the diaphragm 6, and the multiple piezoelectric drivers 7 independently drive the corresponding arrangement portions 61 of the diaphragm 6. Although the piezoelectric driver 7 and the arrangement portion 61 are not disposed in the center portion 8 of the diaphragm 6, the vibration of the arrangement portion 61 driven by the piezoelectric driver 7 propagates to vibrate the center portion 8 of the diaphragm 6, thereby generating the pressure wave in ambient air.

Each of the multiple arrangement portions 61 is disposed between at least two of the multiple cutouts 60 adjacent to each other, and is supported at both ends by the center portion of the diaphragm 6 and a peripheral portion 9 of the diaphragm 6. That is, as illustrated in FIG. 1B, the cutouts 60 are disposed at both ends of the arrangement portion 61 in a first direction C parallel to the surface of the diaphragm 6, and the cutouts 60 are not disposed at both ends of the arrangement portion 61 in a second direction D intersecting the first direction C and parallel to the surface of the diaphragm 6.

In other words, each of the multiple arrangement portions 61 is supported at both ends by the center portion 8 of the diaphragm 6 and the peripheral portion 9 of the diaphragm 6, and at least two adjacent cutouts 60 among the multiple cutouts 60 is disposed on both sides with respect to the double headed arrow indicating the second direction D in FIG. 1B, which is a line connecting both ends at which the arrangement portion 61 is supported. The multiple arrangement portions 61 are separated from each other by the cutouts 60.

Figure 2:
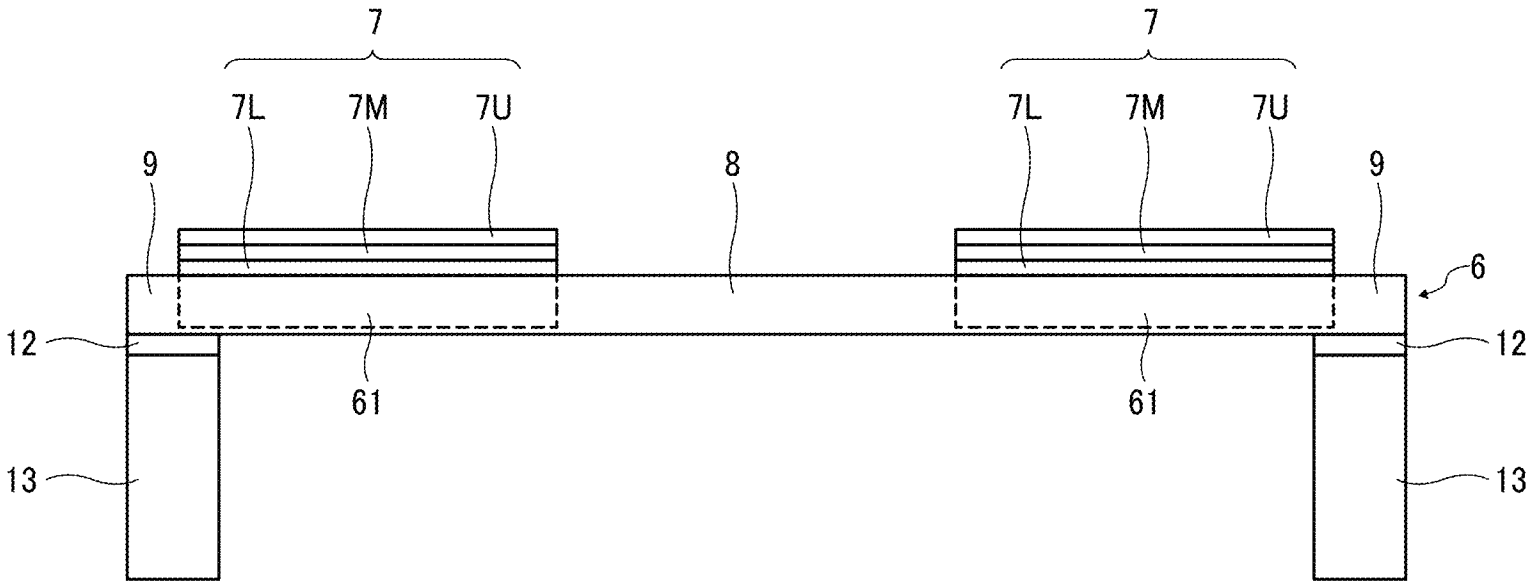
FIG. 2 is a cross-sectional view of the acoustic transducer along line A-A' in FIGS. 1A and 1B.
Figure 3:
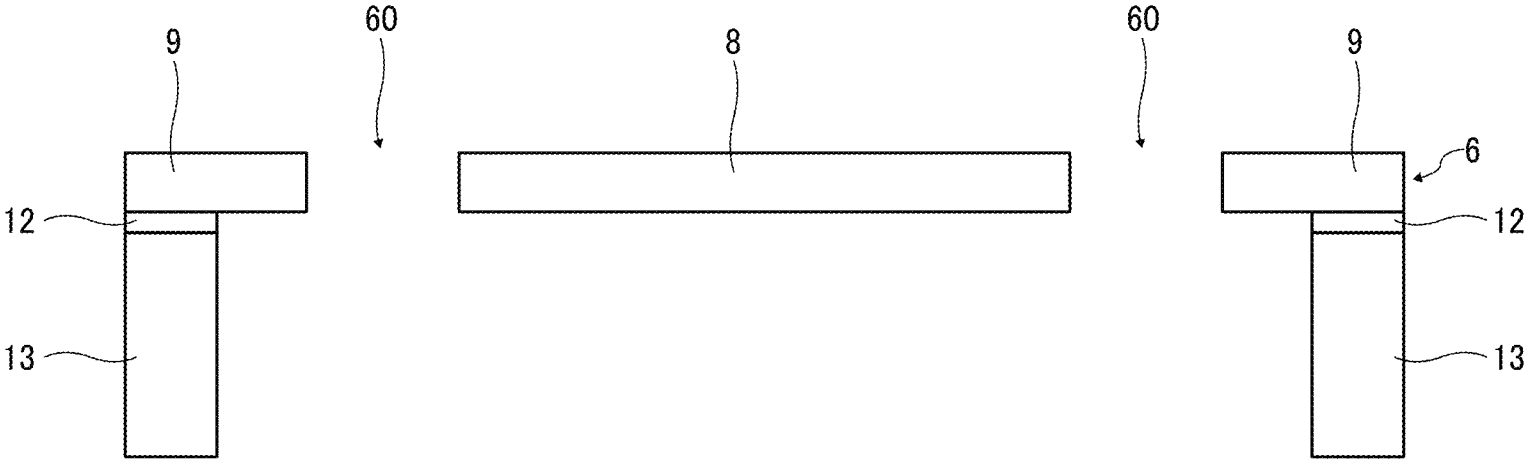
FIG. 3 is a cross-sectional view of the acoustic transducer along line B-B' in FIGS. 1A and 1B.

FIG. 2 is a cross-sectional view of the acoustic transducer 1 along line A-A' in FIGS. 1A and 1B. FIG. 3 is a cross-sectional view of the acoustic transducer 1 along line B-B' in FIGS. 1A and 1B. The piezoelectric driver 7 has a structure in which a piezoelectric material 7M is sandwiched between an upper electrode 7U and a lower electrode 7L. The diaphragm 6 is bonded to and supported by a support layer 13 via a buried oxide (BOX) layer 12. Neither the diaphragm 6 nor the support layer 13 is present in the cutout 60. As illustrated in FIG. 2, the arrangement portion 61 is supported at both ends by the center portion 8 of the diaphragm 6 and the peripheral portion 9 of the diaphragm 6.

Figure 4:
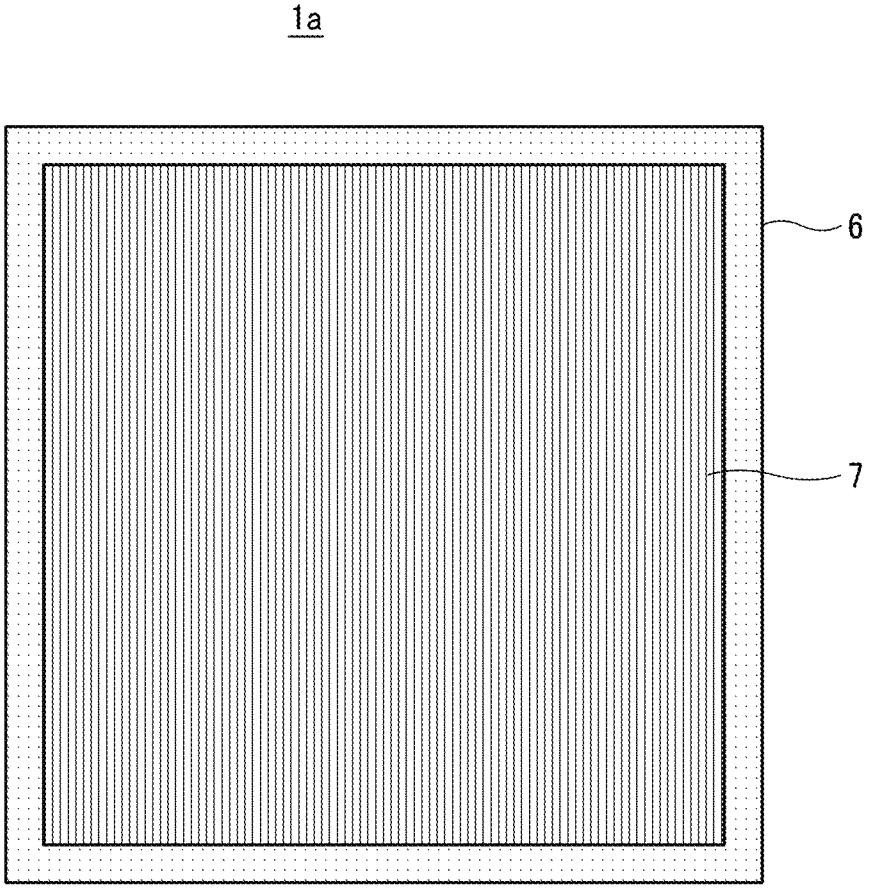
FIG. 4 is a schematic view of an acoustic transducer according to a first comparative example.

FIG. 4 is a schematic view of an acoustic transducer 1*a* according to a first comparative example. In the first comparative example illustrated in FIG. 4, the piezoelectric driver 7 is disposed over substantially the entire portion of the diaphragm 6. As the vibration velocity of the surface of the diaphragm 6 contacting air at a certain frequency increases, the sound pressure level of the sound emitted from the diaphragm 6 at the certain frequency increases.

In the first comparative example illustrated in FIG. 4, the applied voltage to the piezoelectric driver 7 may be increased, or the displacement amount may be increased using the thin diaphragm 6 having the low bending elasticity, thereby increasing the vibration velocity of the surface of the diaphragm 6. An amplifier can increase the applied voltage, but the size of a housing may be increased to accommodate the circuit of the amplifier. The thin diaphragm 6 reduces the strength thereof, which may cause the failure during manufacturing, or use. That is, the acoustic transducer 1*a* according to the first comparative example illustrated in FIG. 4 does not practically increase the sound pressure level.

Figure 5:
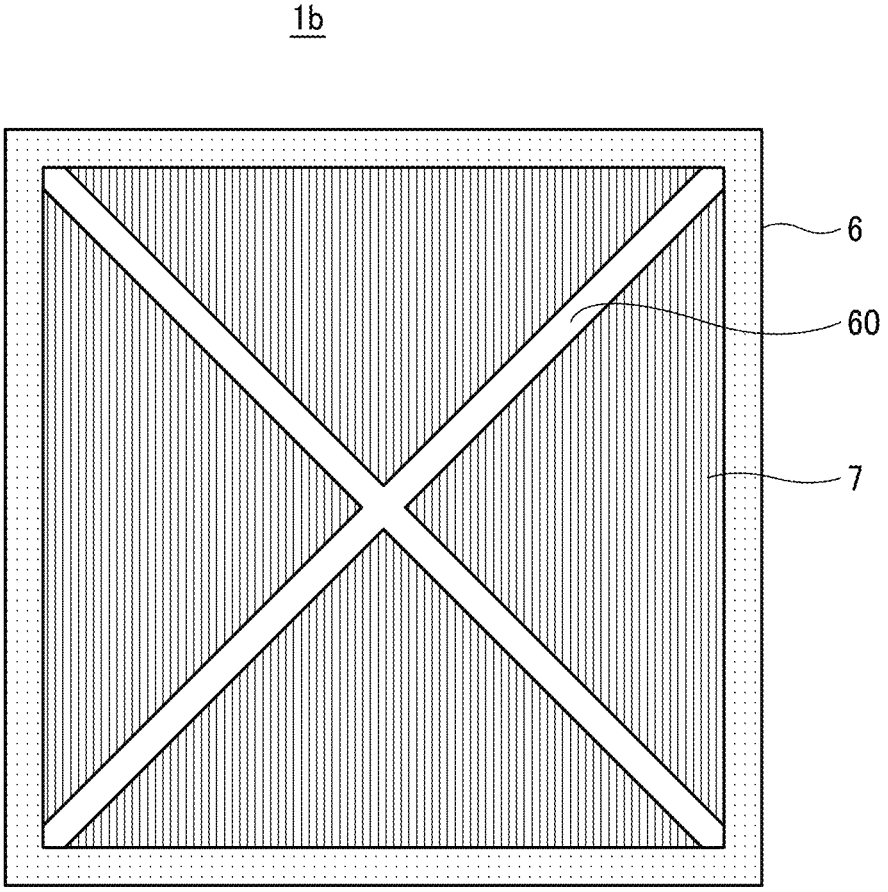
FIG. 5 is a schematic view of an acoustic transducer according to a second comparative example.

FIG. 5 is a schematic view of an acoustic transducer 1*b* according to a second comparative example. In the second comparative example illustrated in FIG. 5, a cutout 60 is disposed in the diaphragm 6, and the multiple piezoelectric drivers 7 are disposed on the diaphragm 6. In the second comparative example illustrated in FIG. 5, the bending elasticity of the diaphragm 6 can be reduced without reducing the strength of the diaphragm 6. Accordingly, the surface velocity vector of the diaphragm 6 increases, and the sound pressure level generated per applied voltage increases. In addition, the area of the piezoelectric driver 7 is smaller than that of the first comparative example illustrated in FIG. 4. Therefore, the piezoelectric driver 7 can be driven with less power consumption as compared at the same applied voltage and the same frequency.

However, in the second comparative example illustrated in FIG. 5, the cutout 60 is disposed in the center portion of the diaphragm 6, and the arrangement portion of the diaphragm 6 on which each of the multiple piezoelectric drivers 7 is disposed is supported (cantilevered) only by the peripheral portion of the diaphragm 6. In this case, the diaphragm 6 is displaced with a component in a direction other than the out-of-plane direction most of time when the arrangement portion on which the piezoelectric driver 7 is disposed deforms. As a result, the directivity of the generated sound pressure decreases, and the sound pressure level per applied voltage at the observation point decreases.

On the other hand, in the acoustic transducer 1 according to the present embodiment illustrated in FIGS. 1 to 3, at least one of the multiple arrangement portions 61 is disposed between two adjacent cutouts 60. As a result, similarly to the second comparative example illustrated in FIG. 5, the bending elasticity of the arrangement portion 61 decreases, and the sound pressure level per drive power for driving the piezoelectric driver 7 increases.

Further, in the acoustic transducer 1 according to the present embodiment, the arrangement portion 61 on which the piezoelectric driver 7 is disposed is supported at both ends. Accordingly, the time when the arrangement portion 61 deforms in the direction other than the out-of-plane direction of the diaphragm 6 is shortened as compared with the case in which the arrangement portion 61 is supported (cantilevered) at one end as in the second comparative example illustrated in FIG. 5. As a result, the directivity of the generated sound pressure increases. Thus, since the direction of sound is not dispersed, the sound pressure level in the normal direction of the surface of the diaphragm 6 increases.

In the acoustic transducer 1 according to the present embodiment illustrated in FIGS. 1 to 3, the multiple cutouts 60 having the same shape are disposed line-symmetrically. Alternatively, the multiple cutouts 60 may be disposed asymmetrically and may have different shapes.

FIGS. 6A and 6B are graphs illustrating the directivity of the sound pressure. FIG. 6A illustrates the directivity of the sound pressure according to the second comparative example illustrated in FIG. 5, and FIG. 6B illustrates the directivity of the sound pressure according to the present embodiment. In FIGS. 6A and 6B, an inclination angle θ indicates an angle of the direction of sound with respect to the normal direction of the surface of the diaphragm 6, and a rotation angle ϕ indicates an angle of the direction of sound around the normal direction of the surface of the diaphragm 6 as a rotation axis.

In the second comparative example illustrated in FIG. 6A, a component of the sound pressure level is not constantly maximum at the inclination angle θ of 0 degrees, and a percentage of components other than the inclination angle θ of 0 degrees is large. That is, the directivity of the sound pressure level is not high. On the other hand, in the present embodiment illustrated in FIG. 6B, a component of the sound pressure level is maximum at the inclination angle θ of 0 degrees, and a percentage of components other than the inclination angle θ of 0 degrees is small. That is, the directivity of the sound pressure is high.

Figure 7:
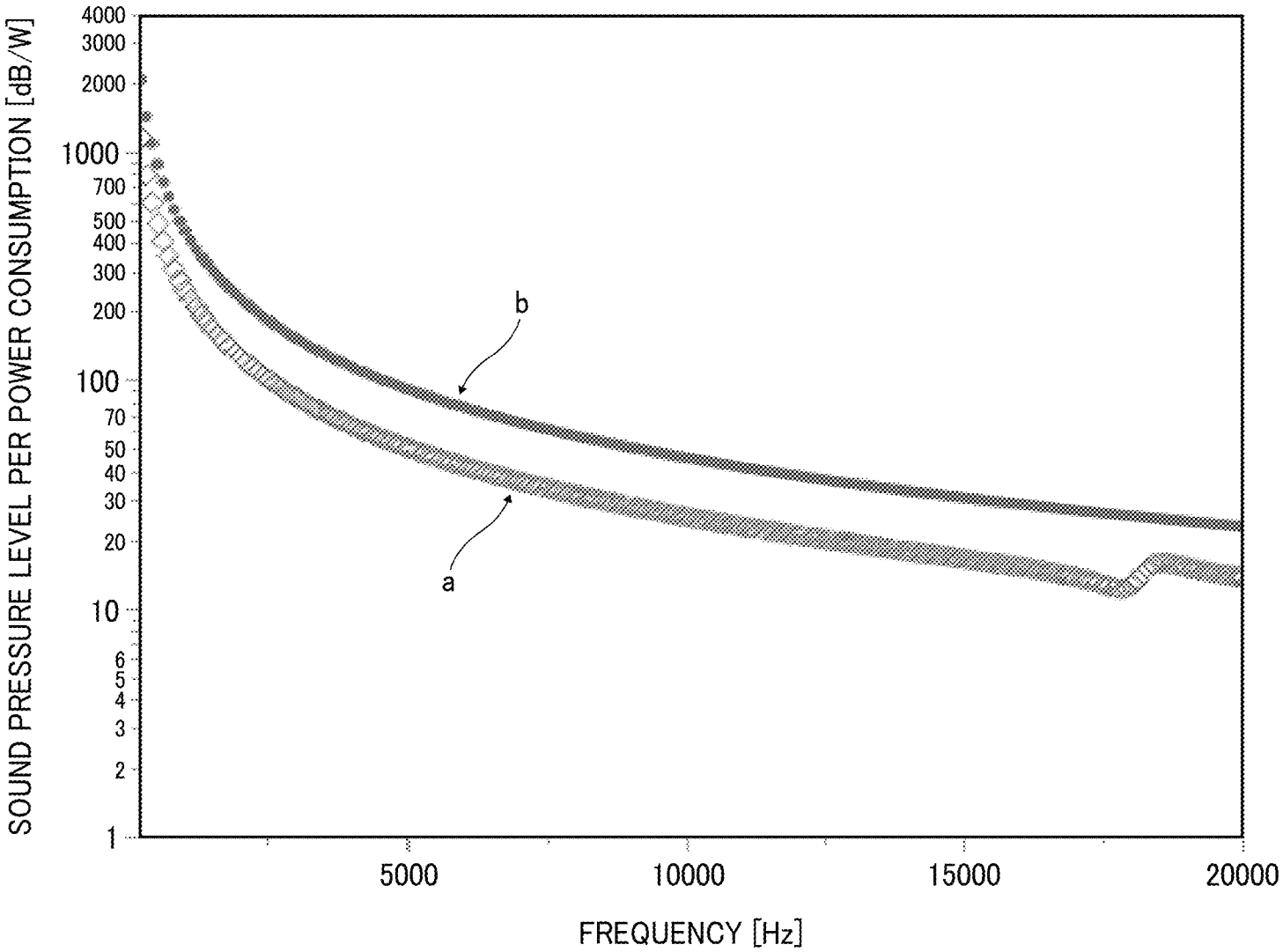
FIG. 7 is graph illustrating sound pressure level per power consumption according to the second comparative example and the present embodiment.

FIG. 7 is graph illustrating sound pressure level per power consumption according to the present embodiment. A graph a illustrates the sound pressure level per power consumption according to the second comparative example illustrated in FIG. 5, and a graph b illustrates the sound pressure level per power consumption according to the present embodiment. As illustrated in FIG. 7, the sound pressure level per power consumption is higher in the present embodiment than in the second comparative example at all frequencies. Specifically, the present embodiment can obtain the same sound pressure level with the power consumption of about 55% compared with the second comparative example.

Figure 8:
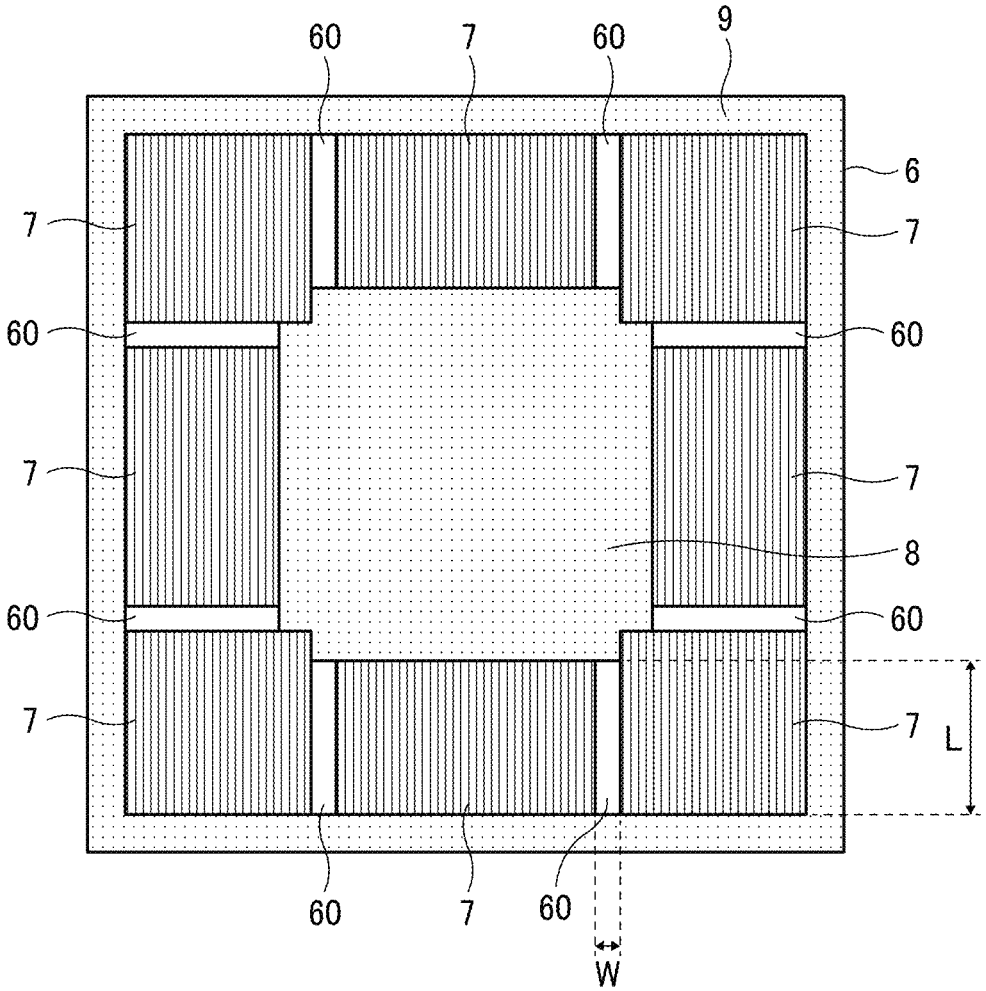
FIG. 8 is a schematic view of the acoustic transducer illustrating a length and a width of a cutout according to the present embodiment.

FIG. 8 is a schematic view of the acoustic transducer 1 illustrating a length and a width of the cutout 60 according to the present embodiment. In the present embodiment, the cutout 60, which is the slit, has a length L in the longitudinal direction and a width W in the transverse direction.

Figure 9:
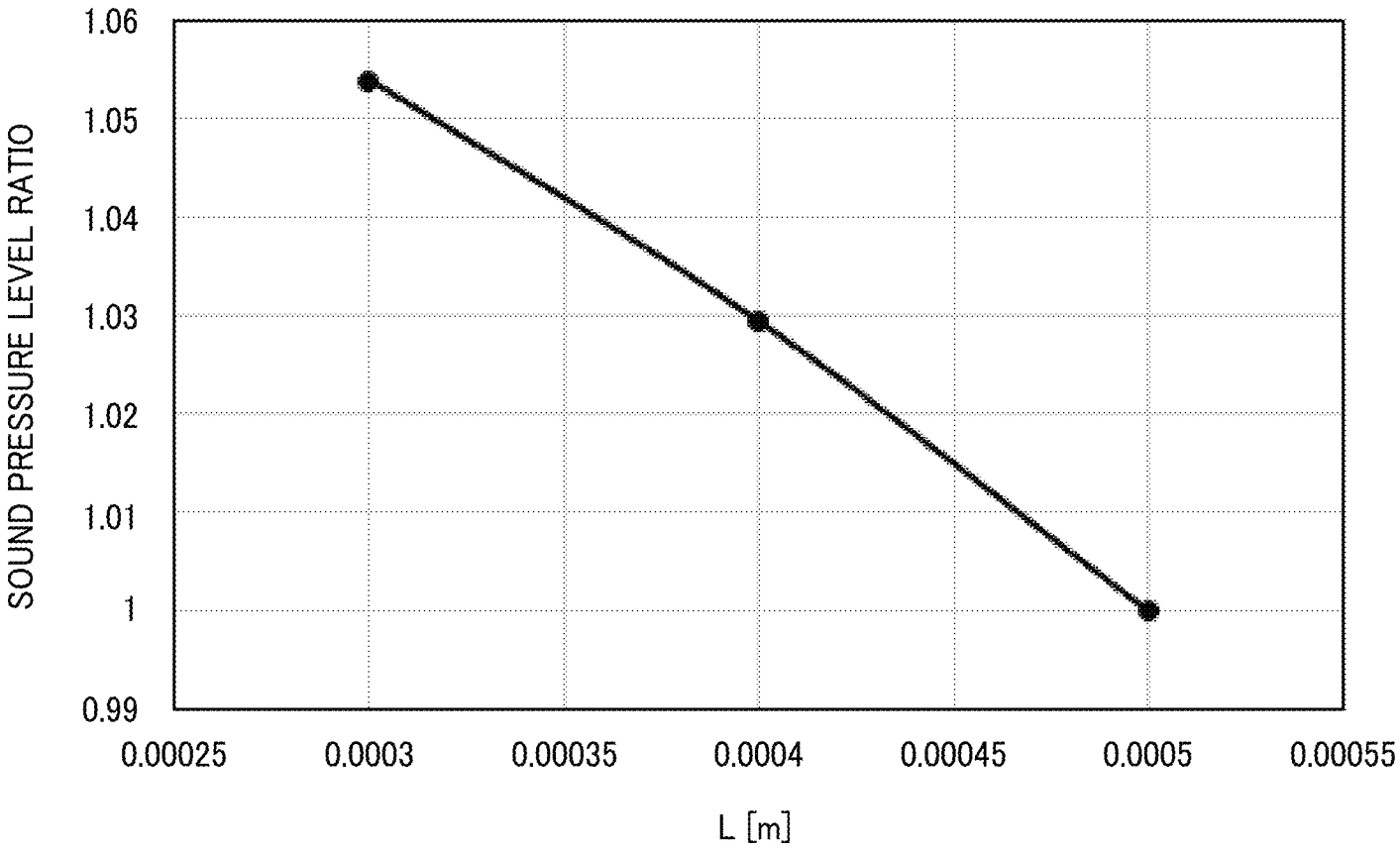
FIG. 9 is a graph illustrating a relation between the length of the cutout and the sound pressure level according to the present embodiment.

FIG. 9 is a graph illustrating a relation between the length L of the cutout 60 and the sound pressure level according to the present embodiment. Specifically, FIG. 9 illustrates the relation between the length of the cutout 60 and the sound pressure level ratio when the width W of the cutout 60 is constant. As illustrated in FIG. 9, the sound pressure level increases as the length L of the cutout 60 in the longitudinal direction decreases.

Figure 10:
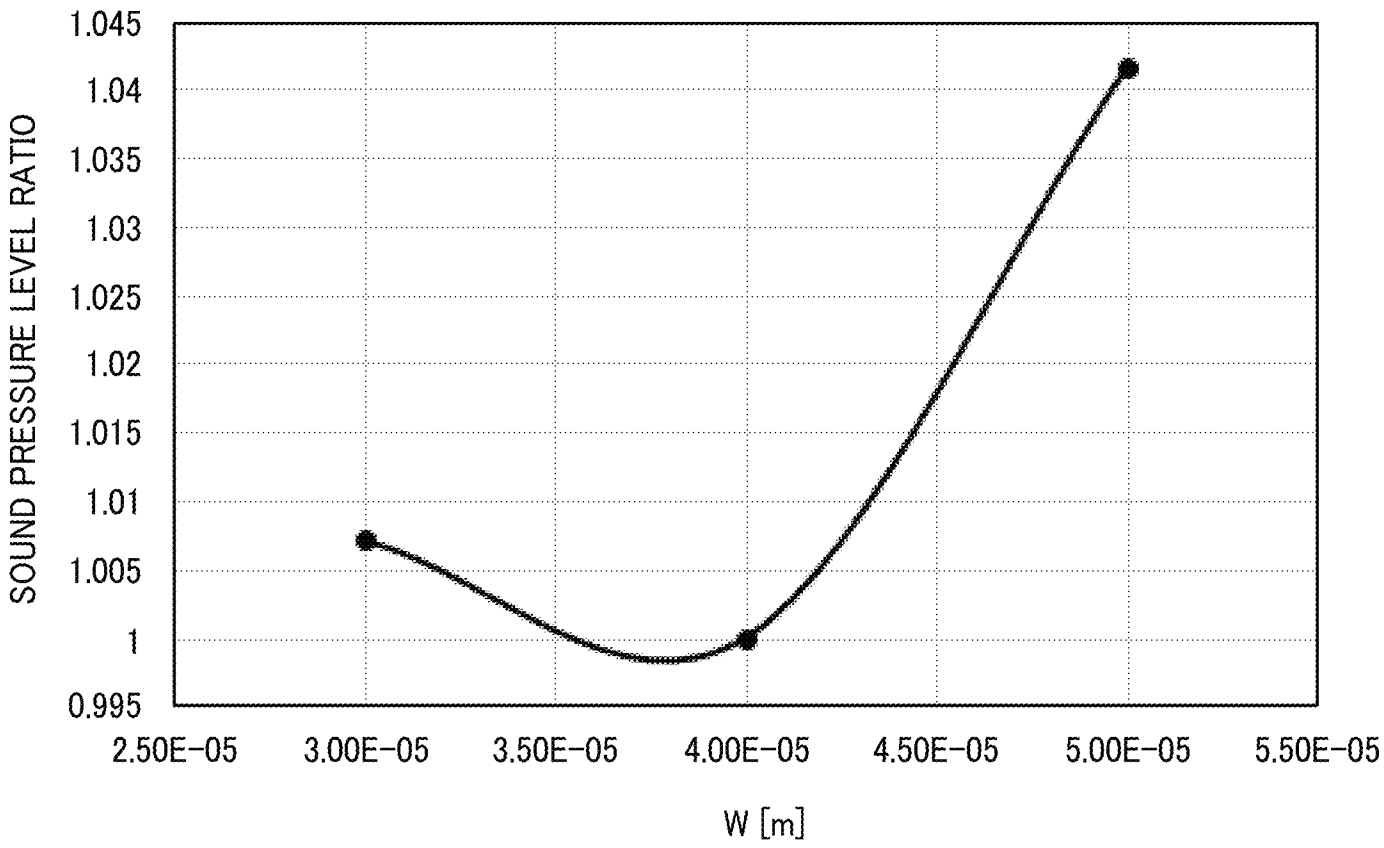
FIG. 10 is a graph illustrating a relation between the width of the cutout and the sound pressure level according to the present embodiment.

FIG. 10 is a graph illustrating a relation between the width W of the cutout 60 and the sound pressure level according to the present embodiment. Specifically, FIG. 10 illustrates the relation between the width W of the cutout 60 and the sound pressure level ratio when the length L of the cutout 60 is constant. As illustrated in FIG. 10, the sound pressure level with respect to the width W of the cutout 60 has a minimum value, and the sound pressure level increases as the width W of the cutout 60 increases.

Figure 11:
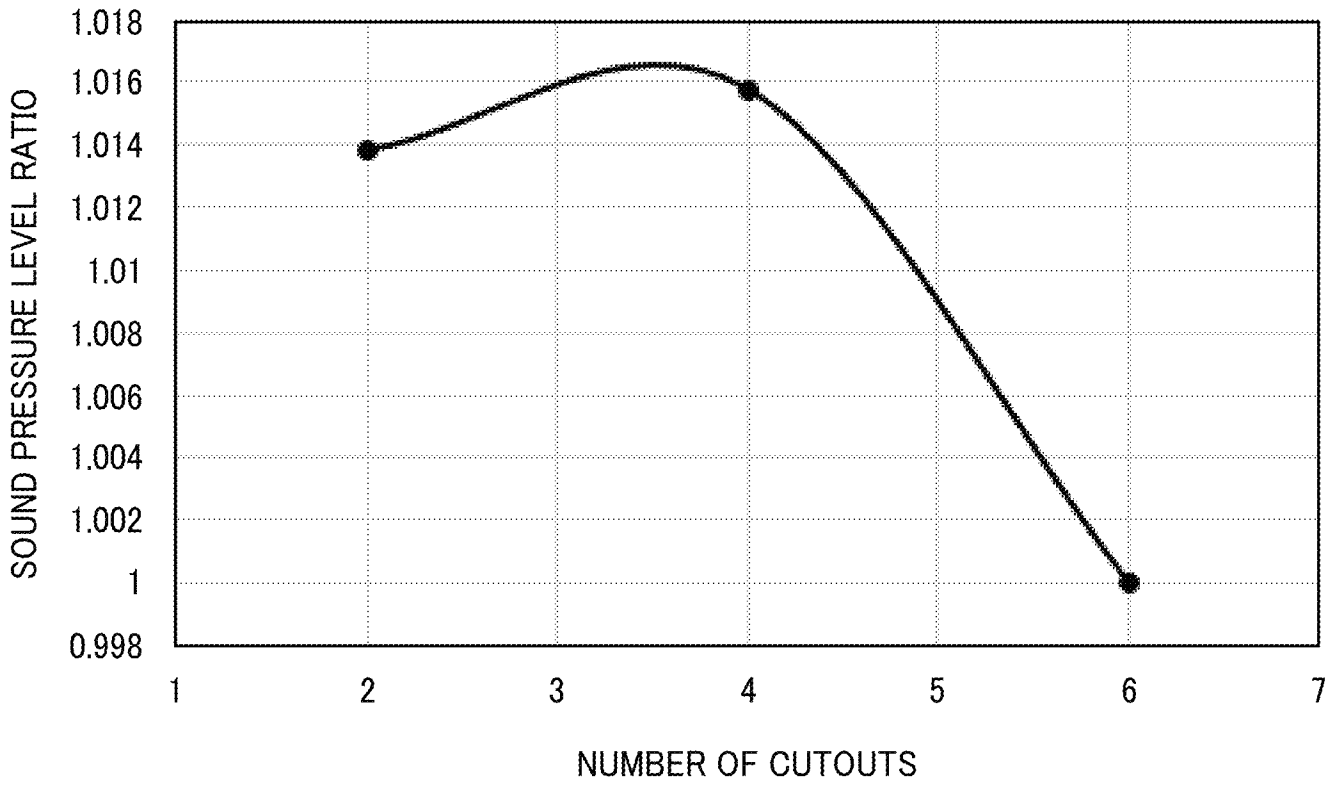
FIG. 11 is a graph illustrating a relation between the number of the cutouts and the sound pressure level according to the present embodiment.

FIG. 11 is a graph illustrating a relation between the number of the cutouts 60 and the sound pressure level according to the present embodiment. Specifically, FIG. 10 illustrates the relation between the number of the cutouts 60 facing one side of the diaphragm 6 and the sound pressure level ratio when the length L and the width W of the cutout 60 are constant. As illustrated in FIG. 11, the sound pressure level with respect to the number of cutouts 60 has a maximum value when the number of cutouts 60 is 3 or 4, and the sound pressure level decreases as the number of cutouts 60 increases.

Figure 12:
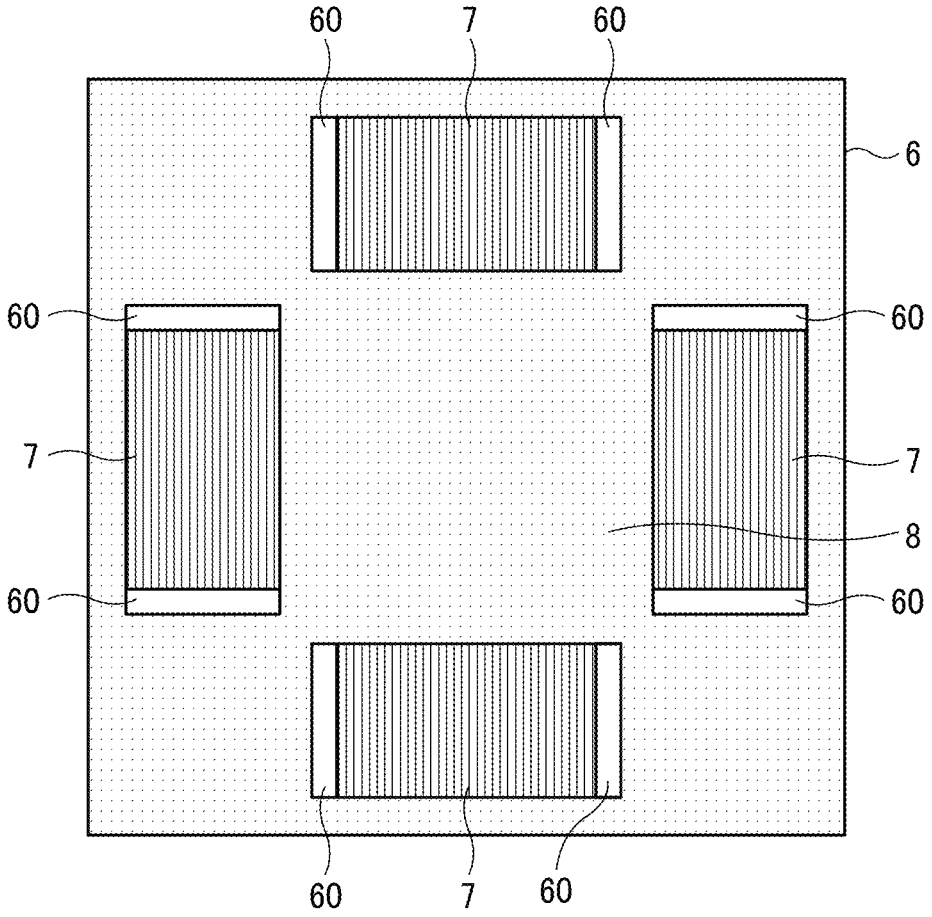
FIG. 12 is a schematic view of an acoustic transducer according to a first variation of the present embodiment.

FIG. 12 is a schematic view of an acoustic transducer 1 according to a first variation of the present embodiment. The first variation illustrated in FIG. 12 is different from the above-described embodiment illustrated in FIGS. 1 to 3 in that the piezoelectric drivers 7 are not disposed at the four corners of the diaphragm 6. As a result, the stiffness at the four corners of the diaphragm 6 without the piezoelectric drivers 7 does not cause the bending elasticity of the diaphragm 6 to increase. Thus, the sound pressure level can be prevented from decreasing.

Figure 13B:
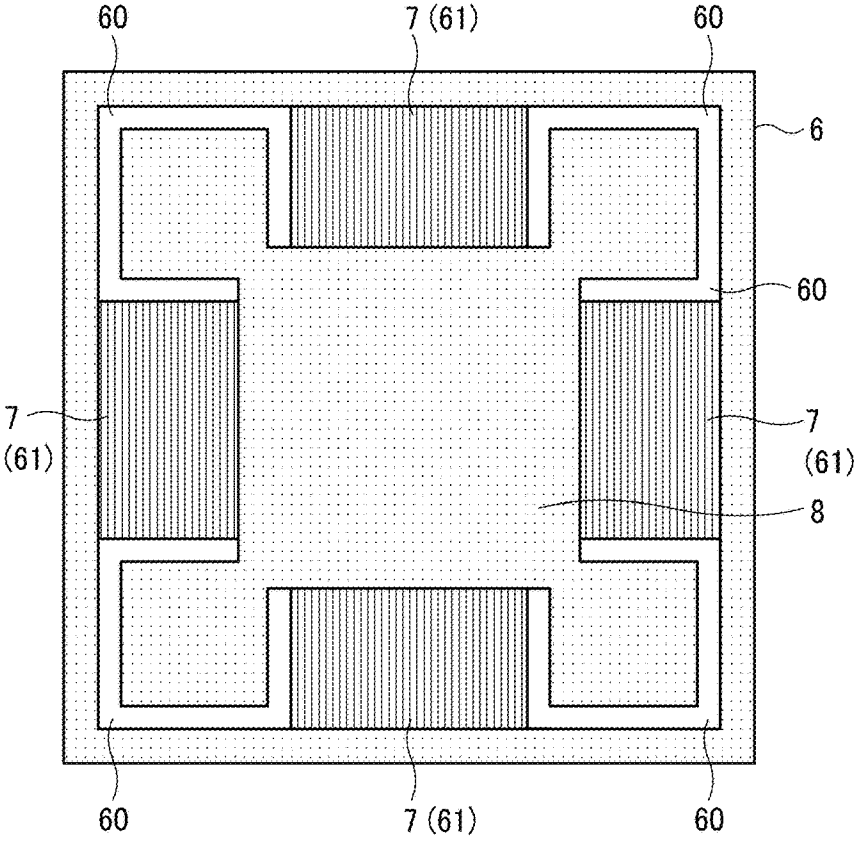
FIGS. 13A and 13B are schematic views of an acoustic transducer according to a second variation of the present embodiment.
Figure 13A:
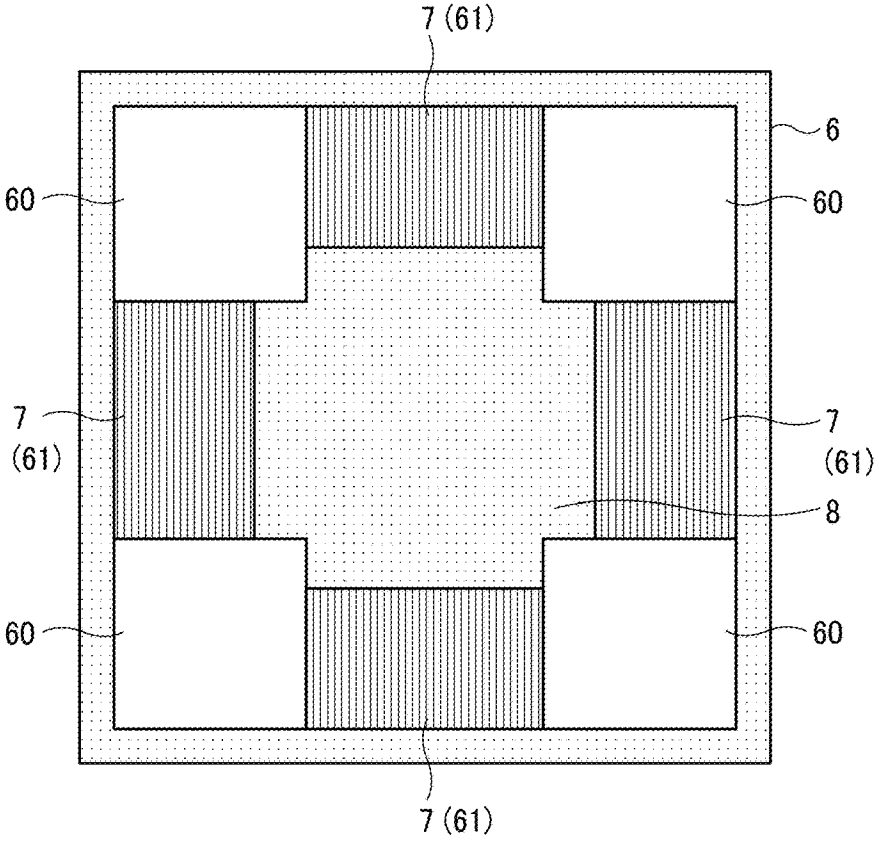

FIGS. 13A and 13B are schematic views of an acoustic transducer 1 according to a second variation of the present embodiment. The second variation illustrated in FIGS. 13A and 13B is different from the first variation illustrated in FIG. 12 in that the cutouts 60 are disposed at the four corners of the diaphragm 6. The cutouts 60 at the four corners of the diaphragm 6 may be square cutouts 60 adjacent to the arrangement portions 61 on which the piezoelectric drivers 7 are disposed as illustrated in FIG. 13A, or may be L-shaped cutouts 60 communicating with the cutouts 60 adjacent to the arrangement portions 61 as illustrated in FIG. 13B. As a result, the stiffness at the four corners of the diaphragm 6 with the cutouts 60 does not cause the bending elasticity of the diaphragm 6 to increase. Thus, the sound pressure level can be prevented from decreasing.

Figure 14:
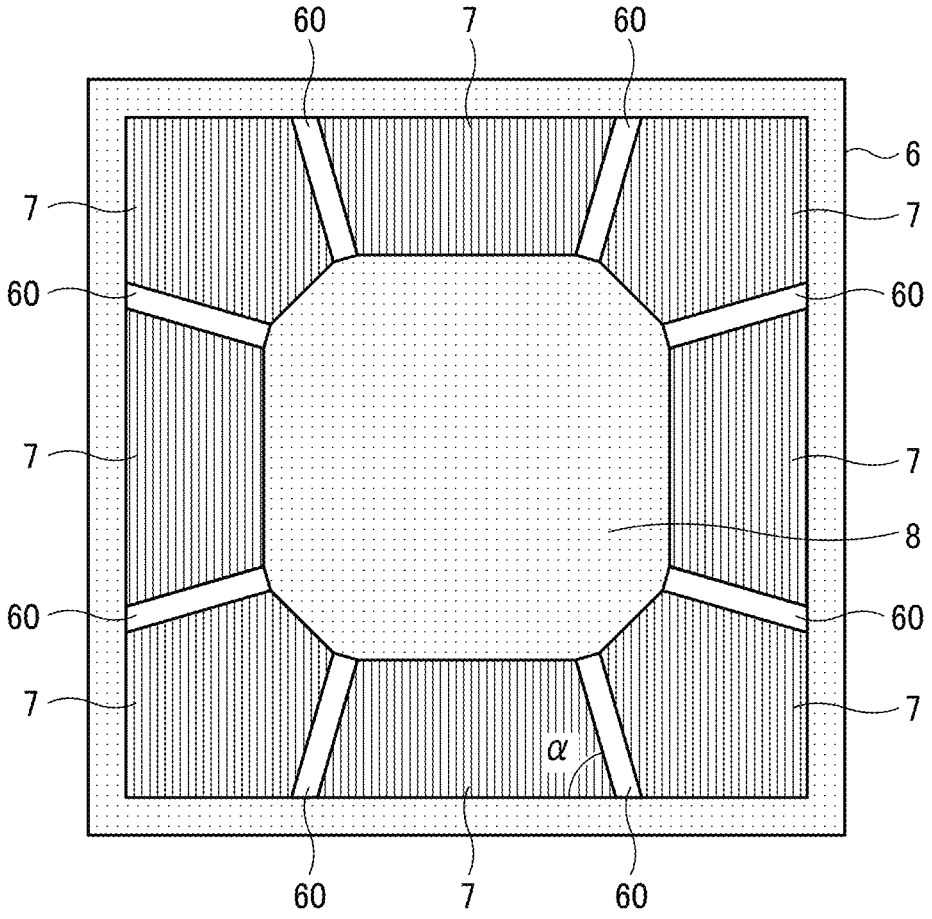
FIG. 14 is a schematic view of an acoustic transducer according to a third variation of the present embodiment.

FIG. 14 is a schematic view of an acoustic transducer 1 according to a third variation of the present embodiment. In the third variation illustrated in FIG. 14, the longitudinal directions of the multiple cutouts 60 are different from those of the above-described embodiment illustrated in FIGS. 1 to 3. Specifically, in the above-described embodiment illustrated in FIGS. 1 to 3, the angle between the longitudinal direction of each of the cutouts 60 and the corresponding side of the diaphragm 6 is 90 degrees, but in the third variation illustrated in FIG. 14, the angle α between the longitudinal direction of each of the multiple cutouts 60 and the corresponding side of the diaphragm 6 is other than 90 degrees. In the third variation, the area of the center portion 8 of the diaphragm is not reduced while the length of the cutout 60 increases. As a result, the sound pressure level is prevented from decreasing.

Figure 15:
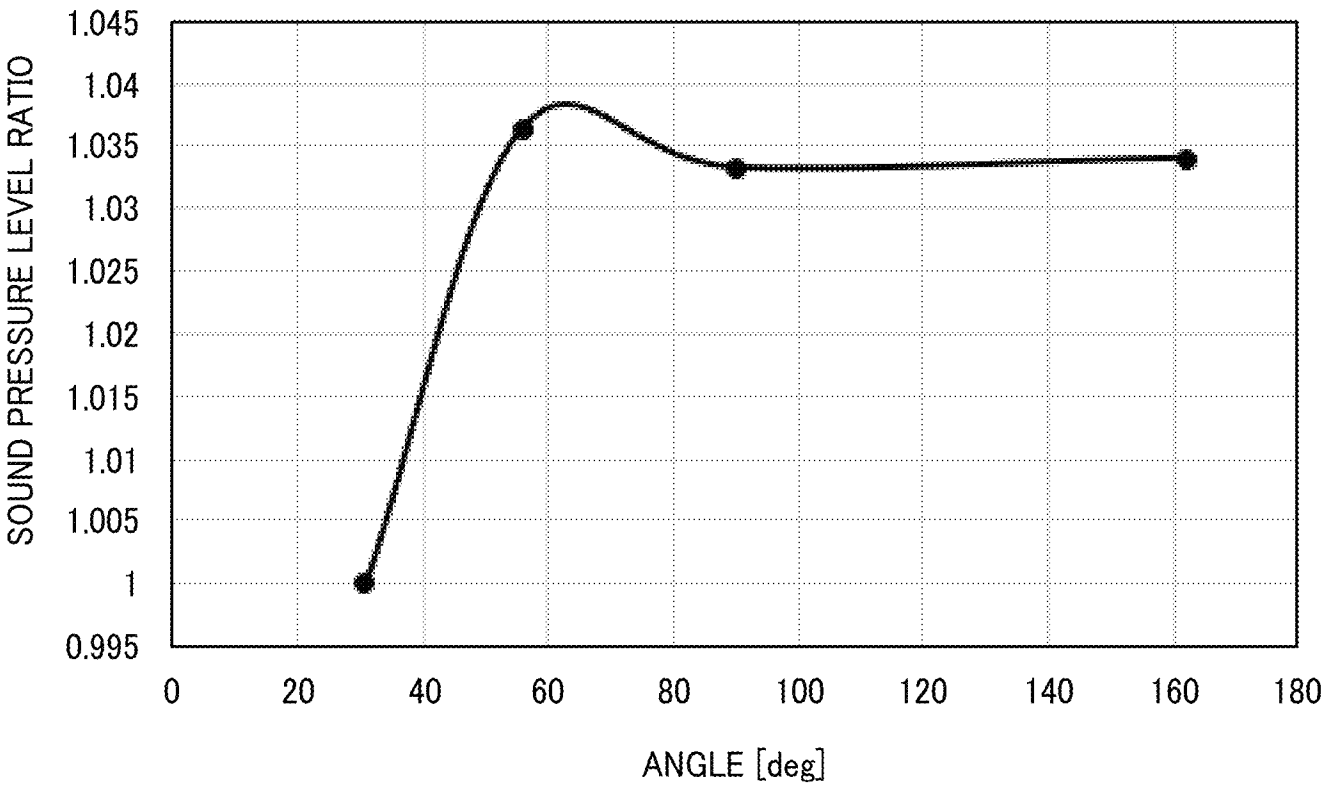
FIG. 15 is a graph illustrating a relation between an angle of the cutout and the sound pressure level according to the third variation.

FIG. 15 is a graph illustrating a relation between the angle α of the cutout 60 and the sound pressure level according to the third variation. Specifically, FIG. 15 illustrates the relation between the sound pressure level and the angle α of the longitudinal direction of the cutout 60 to the corresponding side of the diaphragm 6, which faces the inside of the diaphragm 6, when the length L and the width W of the cutout 60 are constant. As illustrated in FIG. 15, the sound pressure level decreases as the angle α decreases, and the influence of the angle α on the sound pressure level is small when the angle α is 90 degrees or more.

Figure 16:
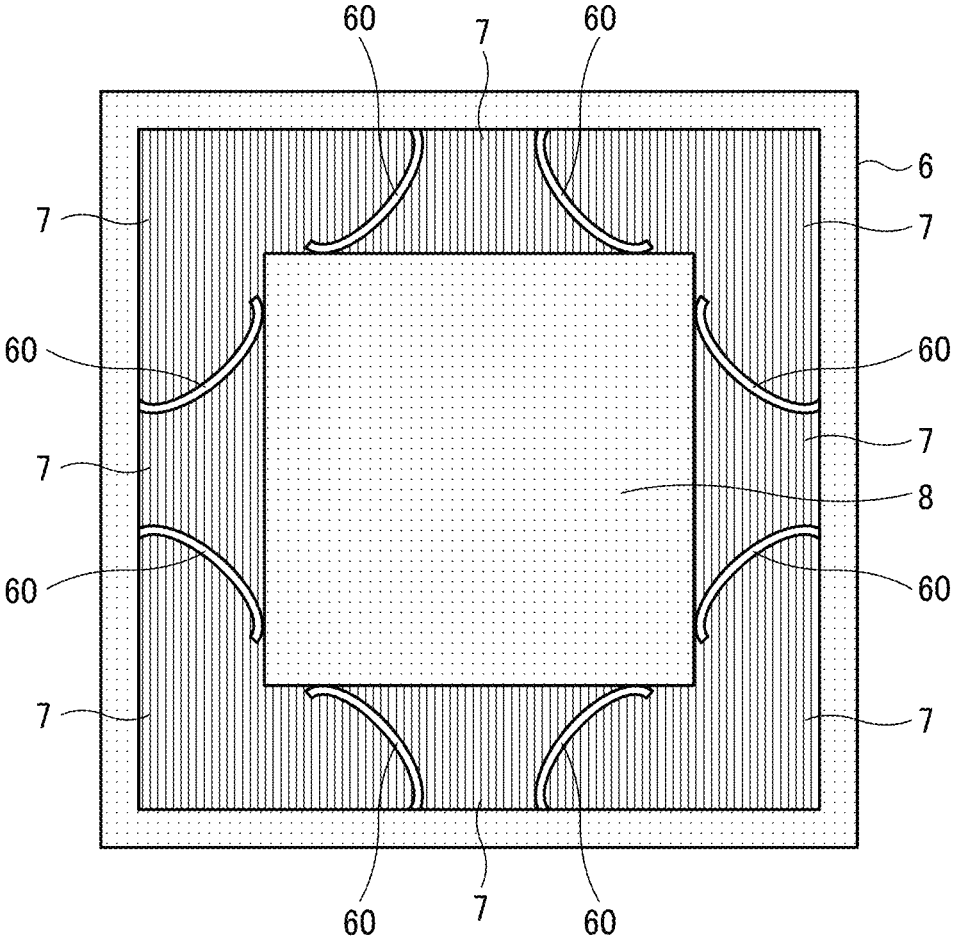
FIG. 16 is a schematic view of an acoustic transducer according to a fourth variation of the present embodiment.

FIG. 16 is a schematic view of an acoustic transducer 1 according to a fourth variation of the present embodiment. In the fourth variation illustrated in FIG. 16, the shape of the multiple cutouts 60 is different from that of the above-described embodiment illustrated in FIGS. 1 to 3. Specifically, in the above-described embodiment illustrated in FIGS. 1 to 3, each of the multiple cutouts 60 is the slit having a linear shape, but in the fourth variation illustrated in FIG. 16, each of the multiple cutouts 60 is the slit having a curved shape. In the fourth variation, the cutout 60 that is the slit having the curved shape can increase the area of the center portion 8 of the diaphragm 6, in which the cutout 60 is not disposed, as compared with the linear cutout 60 having the same length as the curved cutout 60. As a result, the sound pressure level and the directivity of the sound pressure of the entire diaphragm 6 are improved.

Figure 17B:
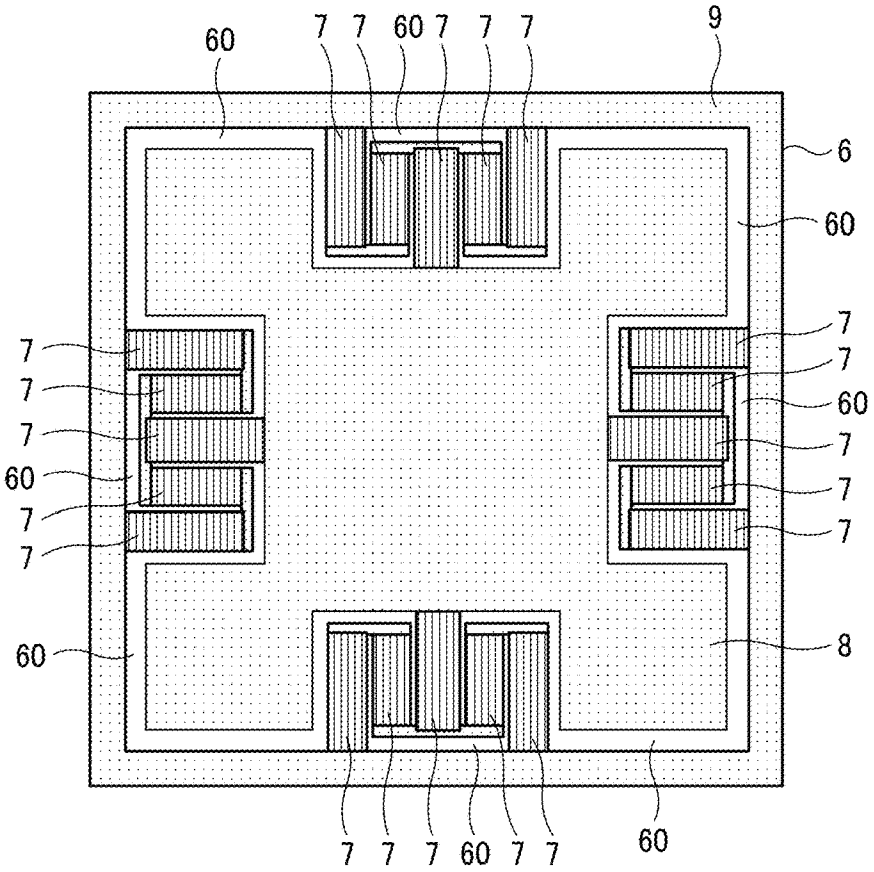
FIGS. 17A and 17B are schematic views of an acoustic transducer according to a fifth variation of the present embodiment.
Figure 17A:
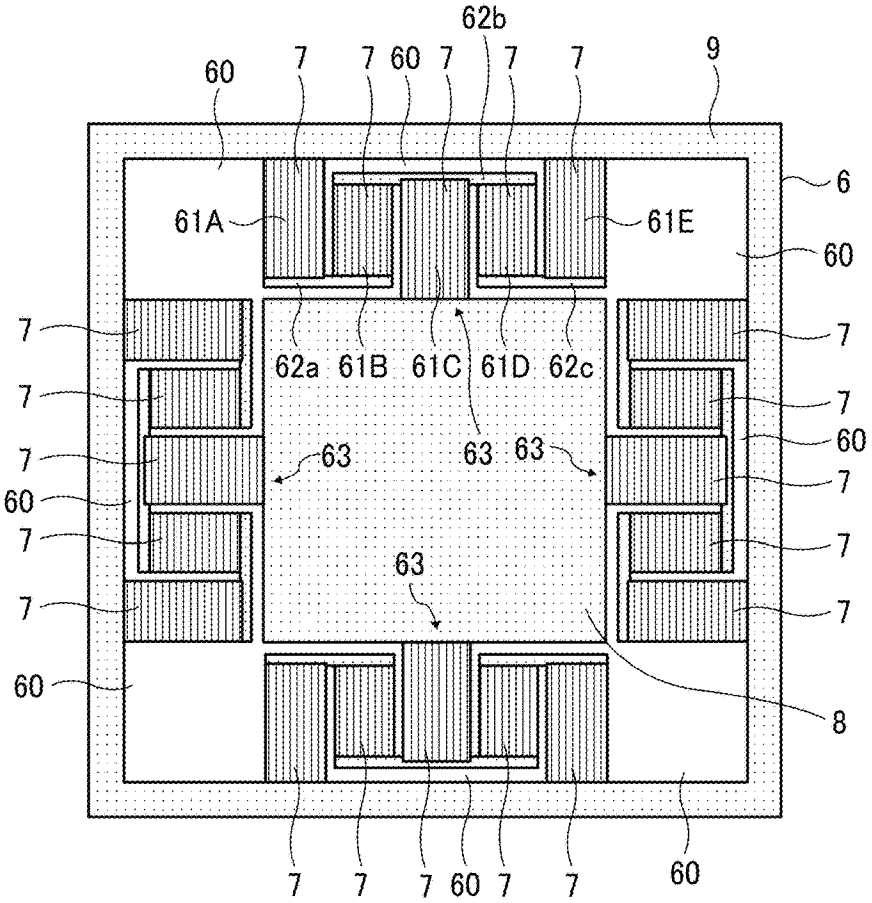

FIGS. 17A and 17B are schematic views of an acoustic transducer 1 according to a fifth variation of the present embodiment. The fifth variation illustrated in FIGS. 17A and 17B is different from the second variation illustrated in FIG.

13 in that the diaphragm 6 includes a folded shape portion 63 formed in a zigzag (in other words, in a meandering shape) and the multiple arrangement portions 61 are disposed in the folded shape portion 63.

In FIG. 17A, the diaphragm 6 includes the folded shape portions 63 formed in a zigzag between the square cutouts 60 at the four corners of the diaphragm 6, and the multiple arrangement portions 61 (61A, 61B, 61C, 61D, and 61E) are disposed in each of the folded shape portions 63. Specifically, the folded shape portion 63 includes the arrangement portion 61A, a coupling portion 62*a*, the arrangement portion 61B, a coupling portion 62*b*, the arrangement portion 61C, the arrangement portion 61D, a coupling portion 62*c*, and the arrangement portion 61E.

One end of the arrangement portion 61A is coupled to the peripheral portion 9 of the diaphragm 6, and the other end thereof is coupled to the coupling portion 62*a*. One end of the arrangement portion 61B is coupled to the coupling portion 62*a*, and the other end thereof is coupled to the coupling portion 62*b*. One end of the arrangement portion 61C is coupled to the center portion 8 of the diaphragm 6, and the other end thereof is coupled to the coupling portion 62*b*. One end of the arrangement portion 61D is coupled to the coupling portion 62*b*, and the other end thereof is coupled to the coupling portion 62*c*. One end of the arrangement portion 61E is coupled to the coupling portion 62*c*, and the other end thereof is coupled to the peripheral portion 9 of the diaphragm 6.

The coupling portion 62*a* couples the arrangement portion 61A and the arrangement portion 61B to each other so that the shape of the folded shape portion 63 turns around in the opposite direction (i.e., the meandering shape). The coupling portion 62*b* couples the arrangement portion 61B and the arrangement portion 61C to each other and couples the arrangement portion 61C and the arrangement portion 61D to each other so that the shape of the folded shape portion 63 turns around in the opposite direction (i.e., the meandering shape). The coupling portion 62*c* couples the arrangement portion 61D and the arrangement portion 61E to each other so that the shape of the folded shape portion 63 turns around in the opposite direction (i.e., the meandering shape).

The multiple arrangement portions 61 are disposed line-symmetrically with respect to the center line of the folded shape portion 63. That is, with respect to the center line of the arrangement portion 61C extending in a direction parallel to the longitudinal direction thereof, the arrangement portion 61B and the arrangement portion 61D are disposed line-symmetrically, and the arrangement portion 61A and the arrangement portion 61E are disposed line-symmetrically.

In FIG. 17B, the diaphragm 6 includes the folded shape portions 63 formed in a zigzag between L-shaped cutouts 60 at the four corners of the diaphragm 6, and the multiple arrangement portions 61 (61A, 61B, 61C, 61D, and 61E) are disposed in each of the folded shape portions 63.

According to the fifth variation, the sound pressure level in the bass range of 20 to 1000 Hz is improved.

As described above, the acoustic transducer 1 according to an embodiment of the present disclosure includes the diaphragm 6 and the multiple piezoelectric drivers 7 as an example of the multiple vibrators to drive the diaphragm 6. The diaphragm 6 has the multiple cutouts 60 and includes the multiple arrangement portions 61. The multiple piezoelectric drivers 7 are disposed on the multiple arrangement portions 61, respectively. At least one of the multiple arrangement portions 61 is disposed between two of the multiple cutouts 60 adjacent to each other and supported at both ends of the at least one of the multiple arrangement portions 61. As a result, the acoustic transducer 1 having the high sound pressure level and the high directivity of the sound pressure can be provided. Specifically, at least one of the multiple arrangement portions 61 is disposed between two adjacent cutouts 60. Therefore, the bending elasticity of the diaphragm 6 is reduced, and the sound pressure level per drive power for driving the piezoelectric driver 7 is improved.

In addition, since the arrangement portion 61 is supported at both ends, the time when the arrangement portion 61 deforms in the direction other than the out-of-plane direction of the diaphragm 6 is shortened as compared with the case in which the arrangement portion 61 is supported (cantilevered) at one end. As a result, the directivity of the generated sound pressure increases. Thus, since the direction of sound is not dispersed, the sound pressure level in the normal direction of the surface of the diaphragm 6 increases. Further, each of the multiple arrangement portions 61, on which the piezoelectric driver 7 is disposed, is disposed between at least two of the multiple cutouts 60 adjacent to each other on the diaphragm 6 and supported at both ends of the each of the multiple arrangement portions 61. As a result, the acoustic transducer 1 having the high sound pressure level and the high directivity of the sound pressure in all the multiple arrangement portions 61 can be provided.

The cutouts 60 are disposed at both ends of the arrangement portion 61 in the first direction C parallel to the surface of the diaphragm 6, and the cutouts 60 are not disposed at both ends of the arrangement portion 61 in the second direction D intersecting the first direction C and parallel to the surface of the diaphragm 6. As a result, the arrangement portion 61 is disposed between at least two adjacent cutouts 60 and supported at both ends of the arrangement portion 61.

The multiple cutouts 60 are disposed in a portion excluding the center portion 8 of the diaphragm 6. As a result, the sound pressure level and the directivity of the sound pressure of the entire diaphragm 6 are improved as compared with the case in which the cutout 60 is disposed in the center portion 8 of the diaphragm 6.

The multiple cutouts 60 include a slit having a curved shape. In the fourth variation, the curved slit can increase the area of the center portion 8 of the diaphragm 6, in which the slit is not disposed, as compared with the linear slit having the same length as the curved slit. As a result, the sound pressure level and the directivity of the sound pressure of the entire diaphragm 6 are improved.

The diaphragm 6 includes the folded shape portion 63 formed in a zigzag, and the multiple arrangement portions 61 are disposed in the folded shape portion 63. Further, the multiple arrangement portions 61 are disposed line symmetrically with respect to the center line of the folded shape portion 63. As a result, the sound pressure level in the bass range of 20 to 1000 Hz is improved.

The acoustic transducer 1 according to an embodiment of the present disclosure includes the diaphragm 6 and the multiple piezoelectric drivers 7 to drive the diaphragm 6. The diaphragm has the multiple cutouts 60 and includes the multiple arrangement portions 61. At least one of the multiple arrangement portions 61 is supported at both ends of the at least one of the multiple arrangement portions 61. Two of the multiple cutouts 60 adjacent to each other are disposed on both sides with respect to a line connecting the both ends at which the at least one of the multiple arrangement portions 61 is supported. The multiple piezoelectric drivers 7 are disposed on the multiple arrangement portions 61, respectively. As a result, the acoustic transducer 1 having the high sound pressure level and the high directivity of the sound pressure can be provided.

As described above, according to the present disclosure, the acoustic transducer having the high sound pressure level and the high directivity of the sound pressure can be provided.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. An acoustic transducer comprising:

a diaphragm having multiple cutouts and including multiple arrangement portions, at least one of the multiple arrangement portions disposed between two of the multiple cutouts adjacent to each other and supported at both ends thereof;

multiple vibrators disposed on the multiple arrangement portions, respectively, to drive the diaphragm; and a peripheral portion surrounding the diaphragm, wherein at least a part of each of the multiple arrangement portions contacts the peripheral portion.

2. The acoustic transducer according to claim 1, wherein each of the multiple arrangement portions is disposed between two of the multiple cutouts adjacent to each other and supported at both ends of the each of the multiple arrangement portions.

3. The acoustic transducer according to claim 1, wherein the two of the multiple cutouts are disposed at both ends of the at least one of the multiple arrangement portions in a first direction parallel to a surface of the diaphragm, and the multiple cutouts are not disposed at both ends of the at least one of the multiple arrangement portions in a second direction intersecting the first direction and parallel to the surface of the diaphragm.

4. The acoustic transducer according to claim 1, wherein the diaphragm further includes a center portion, and wherein the multiple cutouts are disposed in a portion excluding the center portion.

5. The acoustic transducer of claim 4, wherein the multiple cutouts include a slit having a curved shape.

6. The acoustic transducer according to claim 1, wherein the diaphragm further includes a folded shape portion formed in a zigzag, and wherein the multiple arrangement portions are disposed in the folded shape portion.

7. The acoustic transducer according to claim 6, wherein the multiple arrangement portions are disposed line-symmetrically with respect to a center line of the folded shape portion.

8. The acoustic transducer according to claim 1, wherein at least two of the multiple cutouts are parallel to each other.

9. The acoustic transducer according to claim 1, wherein the two of the multiple cutouts adjacent to each other are parallel to each other.

10. The acoustic transducer according to claim 1, wherein each of the multiple arrangement portions has a square or rectangular shape.

11. An acoustic transducer comprising:

a diaphragm having multiple cutouts and including multiple arrangement portions, at least one of the multiple arrangement portions supported at both ends of the at least one of the multiple arrangement portions, two of the multiple cutouts adjacent to each other disposed on both sides with respect to a line connecting the both ends of the at least one of the multiple arrangement portions supported;

multiple vibrators disposed on the multiple arrangement portions, respectively, to drive the diaphragm, and a peripheral portion surrounding the diaphragm, wherein at least a part of each of the multiple arrangement portions contacts the peripheral portion.

* * * * *